US006820997B2

(12) United States Patent
Bissada

(10) Patent No.: US 6,820,997 B2
(45) Date of Patent: Nov. 23, 2004

(54) LIGHTING SYSTEM AND LAMP WITH OPTIMAL POSITION PLACEMENT FOR TELEVISION, NEWS AND MOTION PICTURE STUDIO

(76) Inventor: Mofid Bissada, P.O. Box 1341, El Segundo, CA (US) 90245

( * ) Notice: Subject to any disclaimer, the term of this patent is extended or adjusted under 35 U.S.C. 154(b) by 0 days.

(21) Appl. No.: 10/152,465

(22) Filed: May 21, 2002

(65) Prior Publication Data

US 2003/0218875 A1 Nov. 27, 2003

(51) Int. Cl.[7] ..... F21V 7/10
(52) U.S. Cl. ..... 362/216; 362/260; 362/217
(58) Field of Search ..... 362/84, 216, 325, 362/260, 224, 217, 240, 249, 364, 147, 225; 313/485, 493, 634

(56) References Cited

U.S. PATENT DOCUMENTS 4,099,090 A * 7/1978 Corth et al. ..... 313/487
4,161,767 A * 7/1979 Benasutti et al. ..... 362/33
4,336,479 A * 6/1982 Kodama et al. ..... 313/487
4,363,998 A * 12/1982 Graff et al. ..... 313/487
4,384,318 A * 5/1983 Reibling ..... 362/216
5,235,497 A * 8/1993 Costa ..... 362/224
5,297,011 A * 3/1994 Triunfol ..... 362/147
5,555,162 A * 9/1996 Shemitz ..... 362/225
5,709,460 A * 1/1998 Lester ..... 362/147
5,727,871 A * 3/1998 Kotloff ..... 362/225
5,811,924 A * 9/1998 Okumura et al. ..... 313/487
5,944,572 A * 8/1999 Soules et al. ..... 445/22
6,222,312 B1 * 4/2001 Ghosh et al. ..... 313/487
6,450,668 B1 * 9/2002 Kotloff ..... 362/269
2003/0193798 A1 * 10/2003 Ivey ..... 362/218

* cited by examiner

*Primary Examiner*—Thomas M. Sember
*Assistant Examiner*—Hargobind S. Sawhney

(57) ABSTRACT

A lighting system for projecting a soft light with a flat reflector to provide a fill light with minimal spill light. Conventional light sources, U-shaped glass, fluorescent tubes preferably having phosphor coatings, are located at a position other than parallel to one another, that is, the socket assemblies are mounted in a V position at about 110° angle to opposing ends of the lighting fixture assembly. This placement provides a greater light output than is achievable by positioning the light sources parallel to one another, in addition to increasing the number of tubes used in the small space, thus decreasing the size and/or weight of the housing and increasing the light output. Furthermore, the fluorescent tubes will act as a reflector due to the angled position.

8 Claims, 4 Drawing Sheets

LIGHTING SYSTEM AND LAMP WITH OPTIMAL POSITION PLACEMENT FOR TELEVISION, NEWS AND MOTION PICTURE STUDIO

BACKGROUND OF THE INVENTION

Field of the Invention

This invention relates generally to lighting assemblies for projecting a fill light, and more particularly to a system having a reflector and a fluorescent source wherein the source of the light is optimally placed with reference to both sides of the end plate of the housing, and in addition the tubes will act as a reflector due to the angular mounting position.

Fluorescent lighting in the Motion Picture or TV Studio and on location is a fairly new technology, as only recently have the fluorescent tubes come color corrected with phosphor coatings that permit blending of the fluorescent tube with incandescent halogen bulbs which have been widely used in the filed of Cinematography. It has been a conventional practice to position all fluorescent tubes in parallel to one another and a standard spacing between the socket end assemblies. This parallel tube positioning has always been a common practice in positioning the tubes within the housing. The placement of the tube in parallel is counterproductive, however, in that its light will be absorbed by the housing and spill light will be encountered which has to be corrected by a snoot for pinpoint lighting control to cut any unnecessary spill light. Further, the position of the tubes in parallel increases the dimensions and the weight of the fixture, which only permit smaller quantities of tubes to be spread in a large housing for complete accommodation of the tube size. The purpose of positioning the tube in a V at about a 110° angle on both sides of the housing end panel permits up to doubling the amount of fluorescent tubes in a given housing, thus increasing the light output and decreasing the dimensions of the housing as well as the weight, and in this mounting position the tubes themselves act as a reflector. Furthermore, the complete elimination of the Snoot requirements that were needed to eliminate any spill light is also advantageous.

SUMMARY OF THE INVENTION

The present invention provides much improved illumination and light projection from a given lighting fixture design. Accordingly, it is a primary object of the invention to provide a lighting system which projects an increased amount of light from a given light source and toward a target, given the same power input, than has previously been achievable. Furthermore, another object of the invention to provide a housing that is compact, easy to handle and carry, lighter in weight, lesser in power consumption, higher in light output and simple to assemble and repair. The mounting position of the fluorescent tube angle permits an increase in the amount of tubes utilized in a giving housing, by positioning each tube on both sides of the end panel of the housing thus up to doubling the amount of tubes and reducing the size of the housing. between 33% to 50% from the standard size, in addition to utilizing the fluorescent tubes themselves as a reflector.

BRIEF DESCRIPTION OF DRAWINGS

FIG. 3 Shows a front perspective view of the invention with a housing utilizing 4 tubes within a condensed space by mounting the tubes on both sides of the end panel, with an angle position of the socket which will permit it to have a controlled light flow and furthermore a savings space and an increase in the amount of tubes and light output. FIG. 5 Shows a front perspective view of the invention with a housing utilizing 8 tubes within a condensed space by mounting the tubes on both sides of the end panel and with an angle position of the socket, which will permit to have a controlled light flow and furthermore a savings in space and an increase in the amount of tubes and light output. FIG. 7 Shows a front view of the invention with a housing utilizing 12 tubes within a condensed space by mounting the tubes on both sides of the end panel and with the angle position of the socket, which will permit to have a controlled light flow and furthermore a savings space and an increase in the amount of tubes and light output.

DESCRIPTION OF THE PREFERRED EMBODIMENTS

Figure 1:
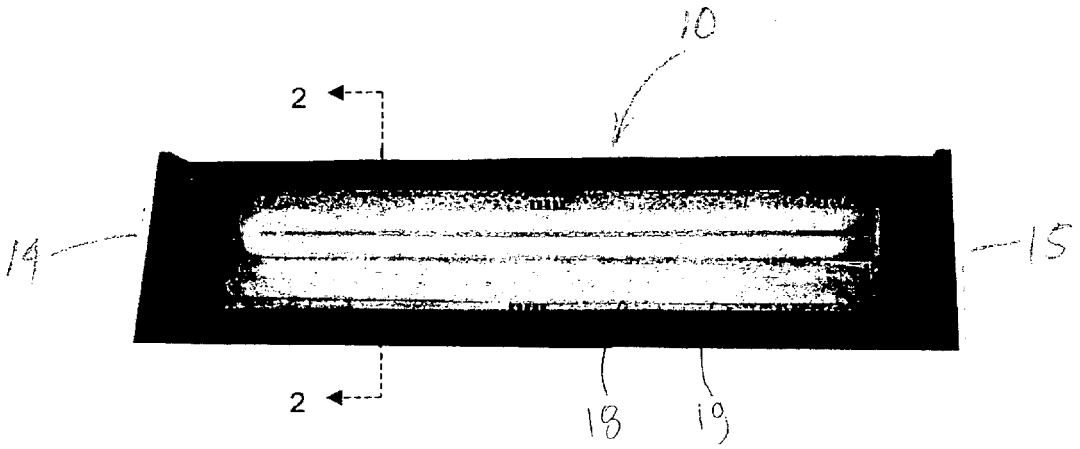
FIGS. 1, 3, 5 and 7 show perspective views of 110, 220, 440 and 660 watt lighting systems.
Figure 2:
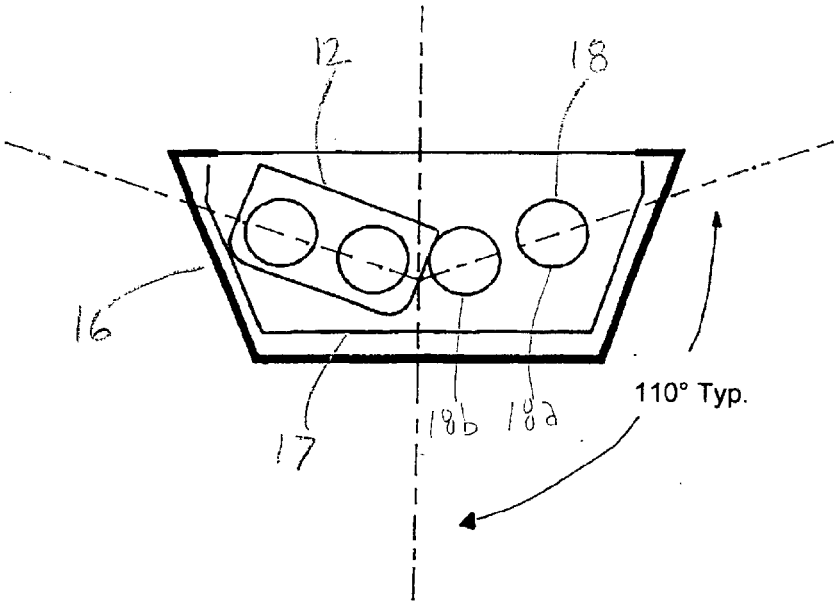
FIGS. 2, 4, 6 and 8 are short cross-section views showing a vertical centerline and the placement of the socket and its angled position on both sides of the end plate. The socket angle position and positioning the socket on both sides of the end plates permits the mounting of up to twice the number of tubes, or the same tubes within ⅔ of the space previously allocated.
Figure 3:
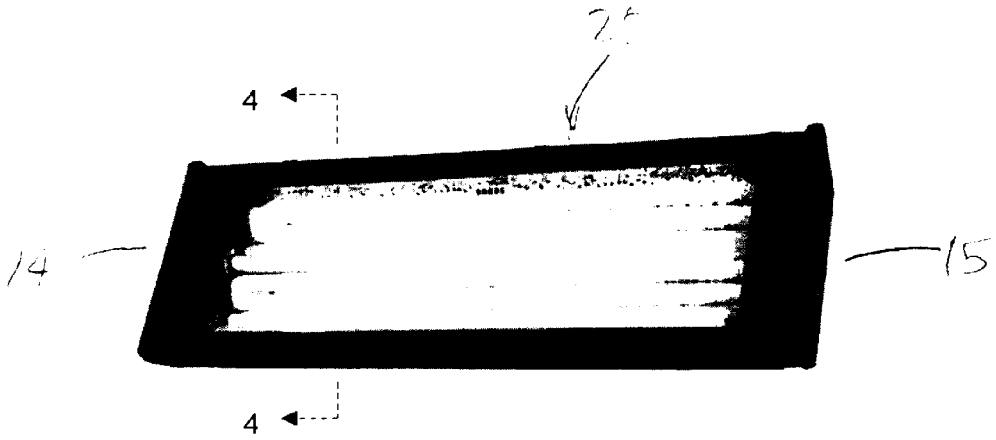
Figure 4:
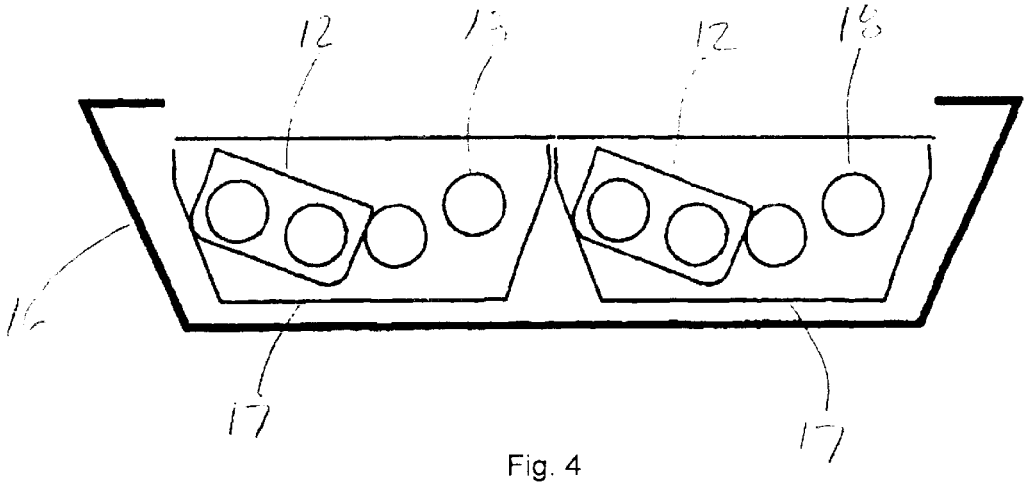
Figure 5:
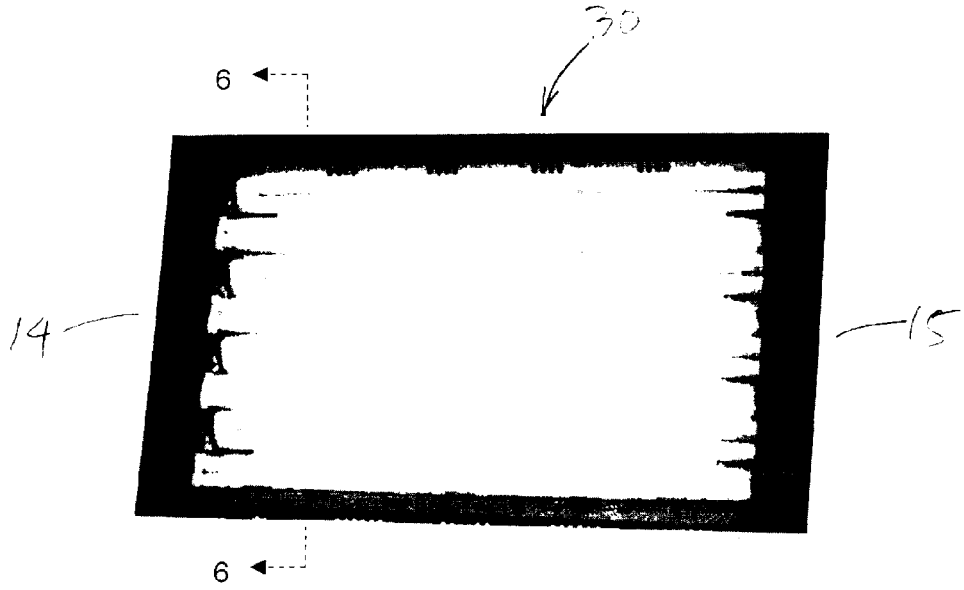
Figure 6:
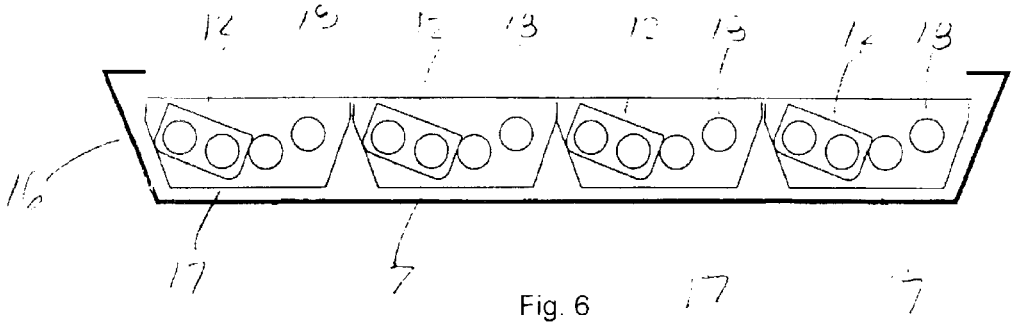
Figure 7:
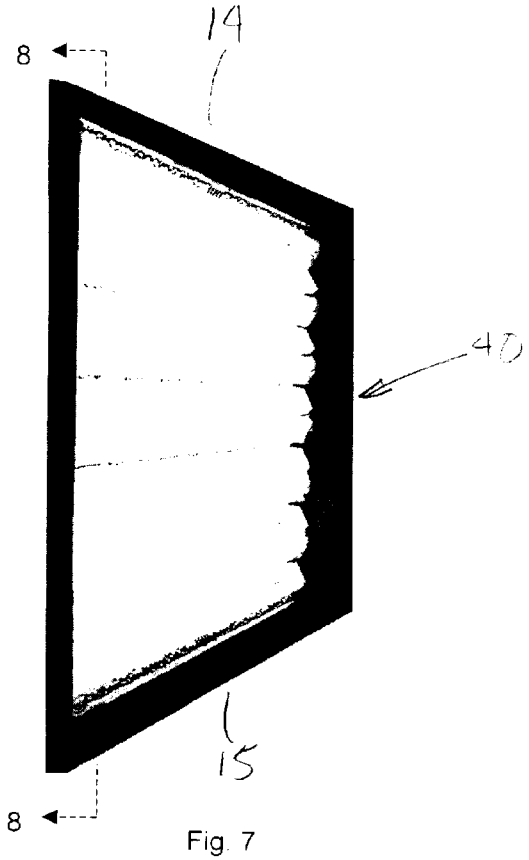
Figure 8:
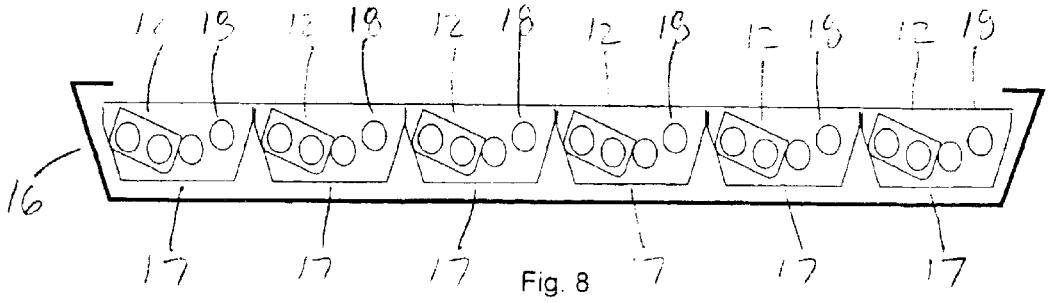

The invention will now be described with reference to preferred embodiments 10, 20, 30 and 40. FIGS. 1-8 show the basic socket mounting position which is contrary to the conventional parallel socket 12 mounting position, by mounting the socket 12 in about a 110° angle on opposite short sides 14, 15 of the housing 16 allowing more tubes 18 in a lesser space, and maximize the benefits of the reflector 17 by increasing the light output within a lesser space. This invention permits maximizing the benefit of the fluorescent tubes 18 beam candlepower and relies solely on the performance of the fluorescent tubes 18 and their approximate 110° mounting angle and the lesser amount of fluorescent tubes 18 within the range of 33% to 50%, rather than increasing the size of the housing which would have resulted in a light loss in a larger housing.

This invention permits the maximization of the fluorescent tubes 18 performance which will result in higher light output and no loss of light within the housing 16, thus allowing the light output to be directed to the object rather than losing most of the light output within the housing 16. This design allows the output of the light to exit the housing 16 and provide fill light towards the object.

Conventional wisdom in the fluorescent tube lighting fixture design teaches that the fluorescent tubes 18 are mounted in parallel position to provide the best output, said to be based on basic geometry principles. This premise has surprisingly been found to be not valid for the U Shape fluorescent tube 18, however, instead, the light sources can be positioned at a different angle and the use of fluorescent tube 18 as a reflector will result in light output superior to the conventional way of mounting.

FIGS. 1-8 illustrate the position of the fluorescent tube 18 mounting positions which permitted the decrease of the housing 16 size and/or an increase in the light output by increasing the quantities of fluorescent tubes 18 utilized within a specific space. Shown are conventional, U-shaped glass, fluorescent tubes 18 having, each having two opposing portions 18*a* and 18*b* and phosphor coatings 19. This position of the mounting of the socket 12 angle allows the light output to be directed in a certain position without any loss of the beam candlepower provided by fluorescent tubes 18, due to the nature of the natural characteristics of the fluorescent tube 18 and utilizing the fluorescent tube 18 as a reflector.

As is apparent from the above description, the invention permits the user to maximize the utilization and performance of the fluorescent U shape tube 18 by increasing the number of the tubes 18 within a dedicated space, and/or decreasing the housing 16 size by a considerable percentage. Preferably the back portion 17 of the housing 16 behind the tubes is substantially flat and may be reflective. This invention allows for the housing 16 to be assembled, meaning that repair of the unit on location also becomes simpler and requires less tools. The ability to control the light output by utilizing a lesser amount of fluorescent tubes 18 can be provided without the need of new design fixture, as the fluorescent tubes 18 are controlled in increments of 1 or 2 tubes independently or collectively. This provides a better lighting control accurately wand without adjustment, the lighting system being controlled via a control board.

The present invention is not intended to be limited to the particular embodiments illustrated but is to cover all such alternatives, modifications, and equivalents as may be included within the spirit and broad scope of the invention as defined by the following claims and their equivalents. In this context, equivalents mean each and every implementation for carrying out the functions recited in the claims, even if not explicitly described herein in this Patent application, and photos referred to herein that are hereby incorporated by reference in their entirety.

What is claimed is:

1. A fluorescent light assembly comprising:

an elongate housing defining a short cross section having a vertical centerline;

a pair of first and second elongate U-shaped glass tubes each having two opposing portions, and mounted lengthwise within said housing at about a 100°–120° angle to the vertical centerline, the pair mounted in close proximity to each other such that the spacing between the portions of each U-Shaped tube and between the pair of tubes is about the same;

whereby the tubes act as reflectors as light from the first pair reflects off the second pair towards the target increasing the light output, and whereby space is conserved inside the housing.

2. The fluorescent light assembly of claim 1 wherein the elongate housing has a substantially flat back portion behind the first tube extending behind the second tube.

3. The fluorescent light assembly of claim 2 wherein the back portion is reflective.

4. The fluorescent light assembly of claim 3, further comprising a plurality of pairs of elongate U-shaped glass tubes assembled side-by-side.

5. The fluorescent light assembly of claim 1 wherein the elongate U-shaped glass tubes have phosphor coatings thereby being color corrected for motion picture and studio work.

6. A light fixture for holding a pair of conventional U-shaped glass tubes each having two opposing portions, the light fixture comprising:

a generally rectangular-shaped box having a pair of opposing short sides each having a vertical centerline; and a pair of electrical receptacles each adapted to receive the tubes, each receptacle attached to one of the short sides inside the box, the electrical receptacles oriented at about 100°–120° to the vertical centerline and in close proximity to one another such that the distance between the portions of each U-Shaped tube and between the pair of tubes is about the same.

7. The light fixture of claim 6, further comprising a pair of conventional U-shaped glass tubes attached to the pair of electrical receptacles.

8. The light fixture of claim 6, further comprising a plurality of pairs of electrical receptacles assembled side-by-side in the light fixture.

* * * * *